US006516820B1

(12) United States Patent
Earnshaw

(10) Patent No.: US 6,516,820 B1
(45) Date of Patent: Feb. 11, 2003

(54) TILTING UMBRELLA

(75) Inventor: John Michael Earnshaw, Huddersfield (GB)

(73) Assignee: Hoyland Fox Limited, Sheffield (GB)

( * ) Notice: Subject to any disclaimer, the term of this patent is extended or adjusted under 35 U.S.C. 154(b) by 0 days.

(21) Appl. No.: 09/674,770

(22) PCT Filed: May 4, 1999

(86) PCT No.: PCT/GB99/01382

§ 371 (c)(1),
(2), (4) Date: Jan. 5, 2001

(87) PCT Pub. No.: WO99/56579

PCT Pub. Date: Nov. 11, 1999

(30) Foreign Application Priority Data

May 6, 1998 (GB) ..... 9809644

(51) Int. Cl.[7] ..... A45B 17/00
(52) U.S. Cl. ..... 135/20.1; 135/20.3; 135/98
(58) Field of Search ..... 135/20.3, 98, 20.1, 135/28, 38, 155

(56) References Cited

U.S. PATENT DOCUMENTS 2,819,725 A * 1/1958 Deisenbroth et al. ..... 135/20.1
2,863,466 A * 12/1958 Small
3,142,307 A * 7/1964 Danciart et al. ..... 135/20.1
3,311,119 A * 3/1967 Pearlstine ..... 135/20.1
3,489,157 A * 1/1970 Pearlstine ..... 135/20.1
3,521,651 A * 7/1970 Pearlstine ..... 135/20.1
3,850,186 A * 11/1974 Weber ..... 135/20.1
3,926,202 A * 12/1975 Uthemann ..... 135/20.1
4,674,522 A * 6/1987 Ma ..... 135/20.1
4,697,606 A * 10/1987 Ma ..... 135/20.1
5,711,333 A * 1/1998 Vanderminden ..... 135/20.3
5,871,024 A * 2/1999 Vanderminden ..... 135/20.1
6,170,497 B1 * 1/2001 Ma ..... 135/20.3

* cited by examiner

*Primary Examiner*—Lanna Mai
*Assistant Examiner*—Winnie Yip
(74) *Attorney, Agent, or Firm*—Antonelli, Terry, Stout, & Kraus. LLP

(57) ABSTRACT

A tilting umbrella frame includes an upper shaft part and a lower shaft part, the two parts being connected by a tilting joint to enable the upper shaft part to tilt about an axis with respect to the lower shaft part. A runner slides on the lower shalt part, to spread the cover of the umbrella into its unfurled configuration, and once the umbrella is unfurled, to tilt the upper shaft part. A lever connected to and arranged outside the upper shaft part transmits a pushing force from the runner to the upper shaft part as the runner is pushed beyond a predetermined point at or near the point corresponding to the completely unfurled configuration. The lower end of the lever is held captive in the runner during tilting to enable the runner to pull the shaft back to the straight configuration.

13 Claims, 7 Drawing Sheets

TILTING UMBRELLA

FIELD

The invention concerns a frame for a tilting umbrella and is particularly useful for a large umbrella or parasol of the type that is used to provide shade at tables and so on. The tilting facility allows the cover of the umbrella to be angled as required by the position of the sun.

BACKGROUND

Large static umbrellas are often tilted by means of a handle mechanism such as a crank or draw cord, because the top of the umbrella is too high to reach or is too heavy. The handle is provided at a level easy for the user to reach and is connected by some mechanism such as a chain, cord or rack to the runner of the umbrella, i.e. the moving part to which the stretchers are attached. The crank thus serves both to lift the runner so as to raise the umbrella into its unfurled position, and to lower the runner so as to lower the umbrella again when required.

The tilting action takes place as the runner reaches its top position, i.e. when the umbrella is completely unfurled. At this point further movement of the runner engages a further member associated with the shaft near the tilting joint, causing the tilt to be carried out. One such mechanism is shown, for instance, in U.S. Pat. No. 3,182,673 (S. N. Small), which shows a crank mechanism raising a runner which in turn slides a pin in an angled slot in the upper shaft member. The angle gives rise to a cam action bringing about a tilt of the upper shaft member.

The Small construction is rather unusual in that the tilting hinge is located above the runner, even when the runner is slid to its operating position. In most tilting umbrellas, such as for instance in U.S. Pat No. 3,850,186 (Weber et al.), U.S. Pat No. 4,697,606 (Ma) or U.S. Pat. No. 5,029,596 (Tung) the runner first slides on to the upper shaft part, and then tilts with it. This latter construction has problems of stability and is of little significance to the present invention.

While devices of the type shown in the Small patent have been known for a long time, they have the disadvantage that cutouts must be made in the shaft to accommodate various parts of the mechanism, in particular the sliding pin. This weakens the assembly; moreover the insertion of a considerable number of connecting parts into the shaft is tricky from the manufacturing point of view. It is an aim of the present invention to mitigate these disadvantages.

SUMMARY

According to the invention there is provided an umbrella frame including an upper shaft part and a lower shaft part, the two parts being connected by a tilting joint to enable the upper part to tilt with respect to the lower, a runner sliding on the lower shaft part, for spreading the cover of the umbrella into its unfurled configuration, and a lever connected to and arranged outside the upper shaft part, arranged to tilt the upper shaft part under the influence of the runner as the runner is pushed beyond a certain point at or near the point corresponding to the completely unfurled configuration.

Because the lever is outside the shaft the integrity of the shaft construction can be maintained while preserving the advantage of stability afforded by having the runner slide only on the lower shaft part, i.e. with the tilt joint above the runner. Also the lever construction allows a particularly simple assembly with only two moving parts other than the runner, namely the lever and the upper shaft part.

Preferably the tilt axis is located radially outwards of the axis of the shaft, and the attachment of the lever to the upper shaft is about a horizontal hinge generally on a level with and parallel to the tilt axis, on the opposite side with respect to the axis of the umbrella shaft so as to afford the necessary leverage. It is best if during its action the lever is held captive by the runner, so that the runner can pull the lever down as well as push it up. This can be achieved by giving the lever a lug near its lower end, facing outwards and engaged by an inwardly facing lip of the runner. In order to allow release of the lug from the lip, so that the runner is free to travel down the shaft to fold the umbrella, the shaft can have a recess at some point on the travel of the runner, preferably at the point at which the runner first engages, so as to allow the end of the lever to be pressed further radially inwards as the runner travels downwards and thus to release the connection of the lever to the runner.

A restoring means such as a spring urging the lower end of the lever against the shaft can be provided, so as to ensure that the runner travels over the lug of the lever as it travels upwards, allowing engagement, and the runner and lug can have suitable inclined surfaces such that the upward movement of the runner lifts the lower end of the lever out of the recess, freeing the lever to be pushed upwards.

The invention is particularly applicable to tilting umbrellas of the kind in which unfurling and tilting the umbrella is performed by means of a crank, draw cord or other means lower down on the lower shaft part, i.e. accessible to a user, and in the case of a crank some device such as a cable or rack mechanism for transforming the turning action into a lift of the runner and, subsequently, a tilt.

For a better understanding of the invention an embodiment of it will now be described, by way of example, with reference to the accompanying drawings, in which.

Figure 5:
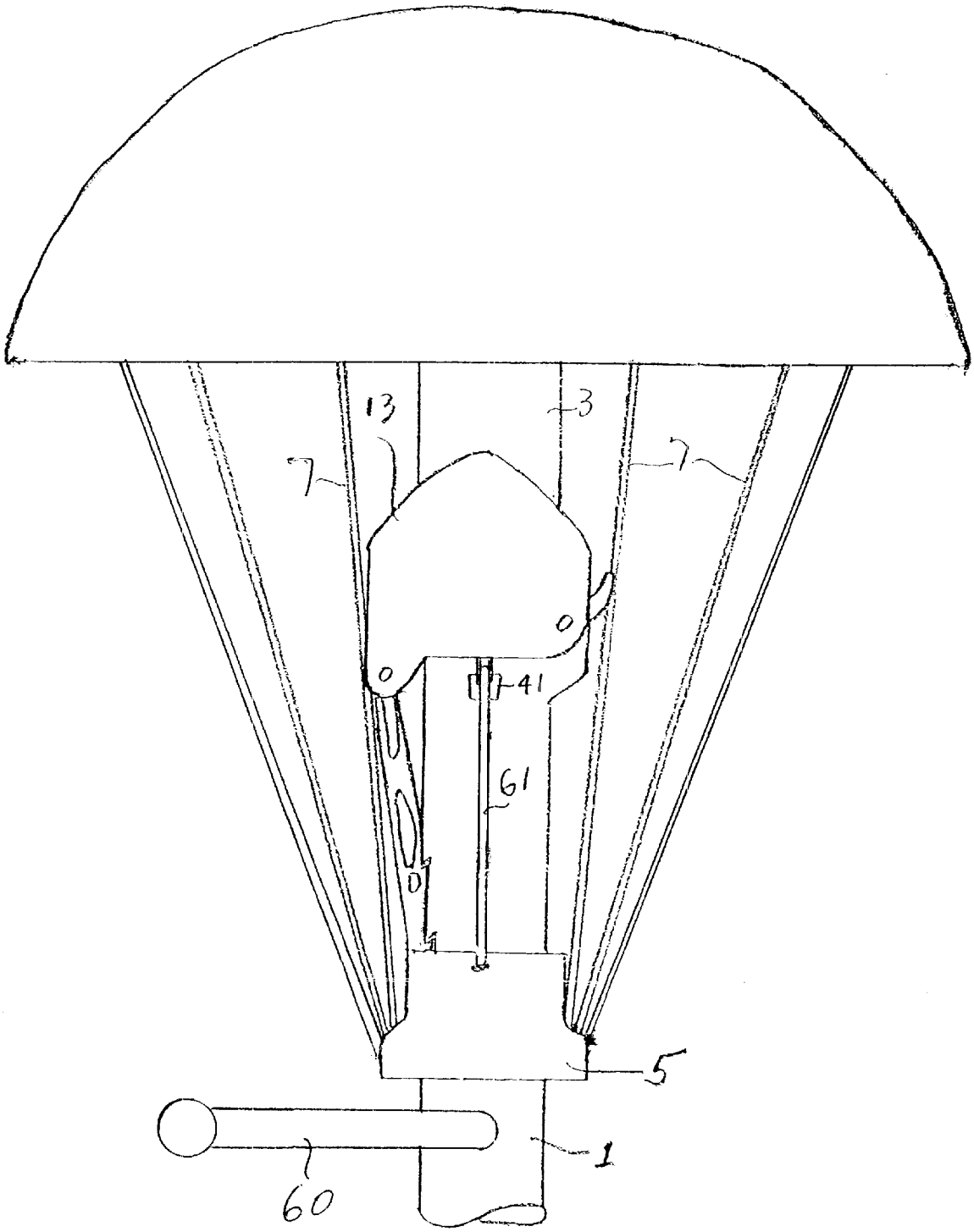
Figure 6:
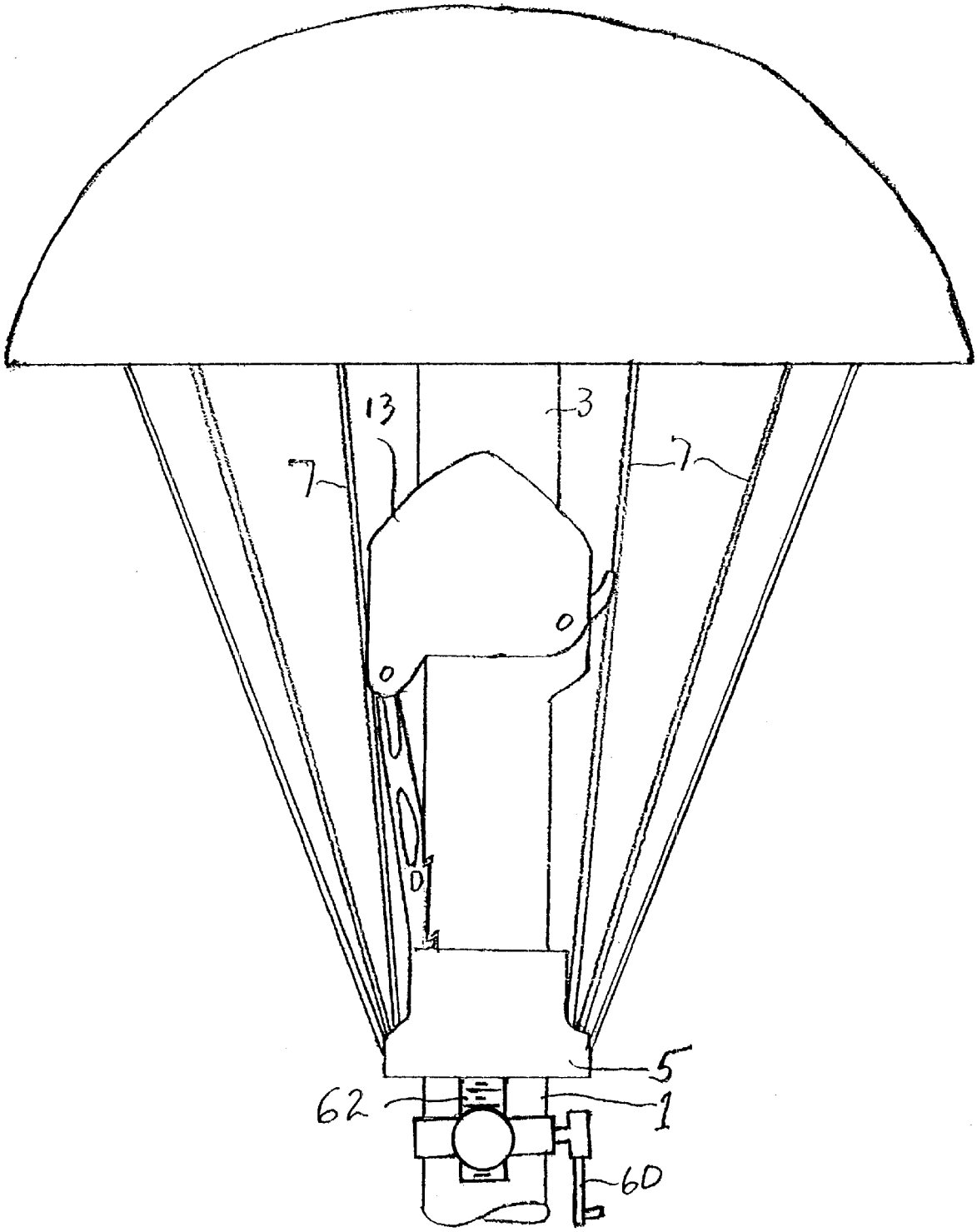
Figure 7:
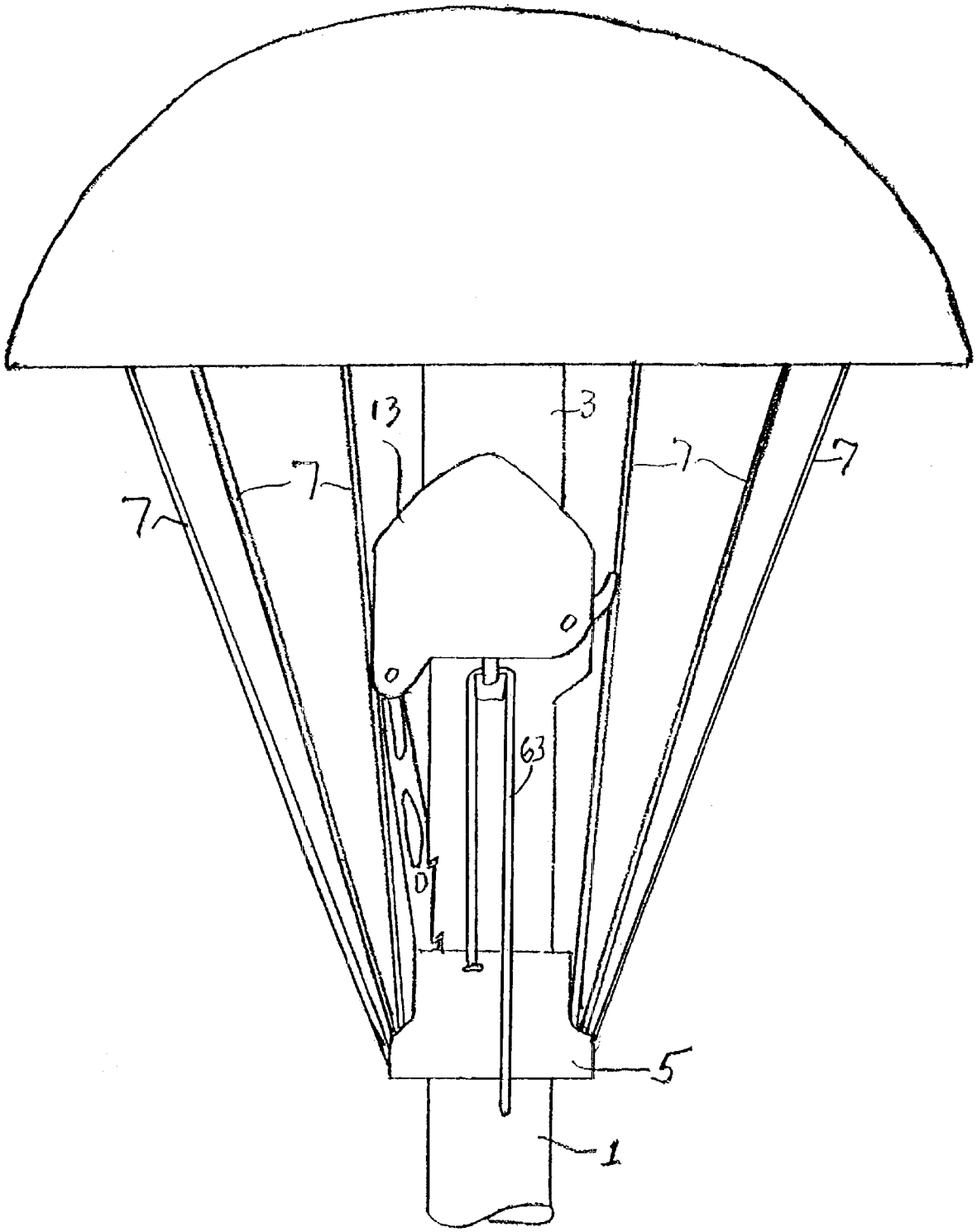

Each of FIGS. 5, 6, and 7 shows a perspective view of an alternative embodiment of an umbrella frame in accordance with the present invention, together with an umbrella cover.

DESCRIPTION

Figure 1:
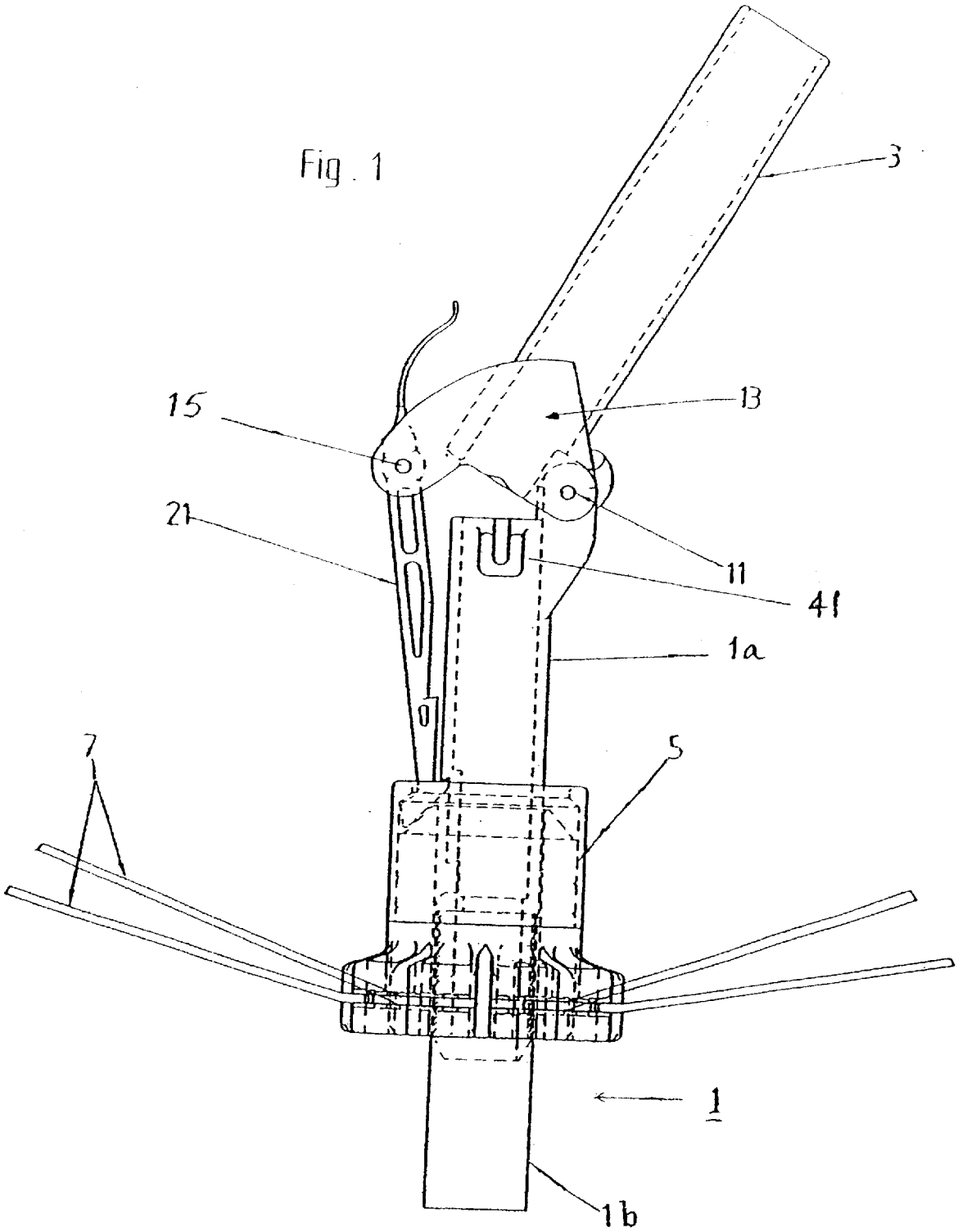
FIG. 1 shows a perspective view of the runner and tilt assembly in the position where the head has just started to tilt.
Figure 2:
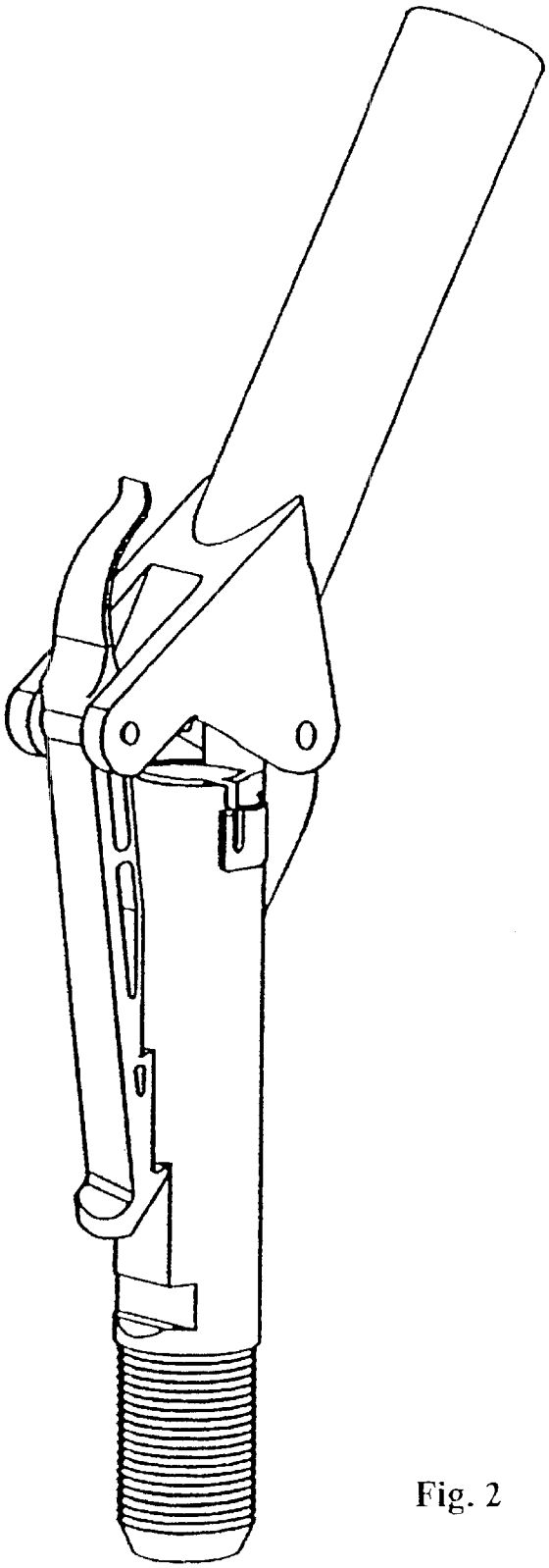
FIG. 2 show the two shaft parts with the lever, in the tilted configuration but with the runner omitted.

In FIG. 1 an umbrella shaft is in two parts, a lower part 1 and an upper part 3 pivoting on the lower part 1 about an axis 11. At the top of the upper part 3, though not shown, there is the usual head with ribs extending radially and supporting a cover. On the lower shaft part there is a slider or runner 5 from which extend, likewise radially and corresponding in number to the ribs, stretchers 7 meeting the ribs somewhere along their length so as to hold them extended with the cover taut when the umbrella is in use. To fold the umbrella the runner is slid down the lower shaft part 1 in the usual way.

It is possible to design a tilting umbrella so that the tilt action is independent of the movement of the runner, although clearly the runner does have to be near its uppermost position for a tilt movement to be possible or of any use, since otherwise the umbrella cover is folded. However, particularly with large sunshades it represents a simplification for the user for the tilt to happen automatically on further movement of the runner after it has more or less reached its top position, and the invention is concerned with this kind of mechanism.

Figure 3B:
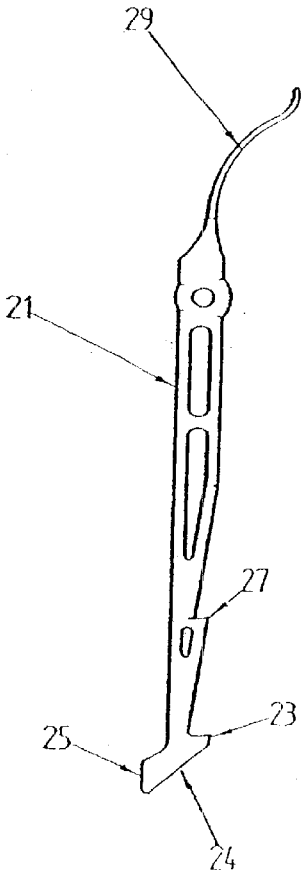
FIG. 3B shows a side view of the lever.
Figure 3A:
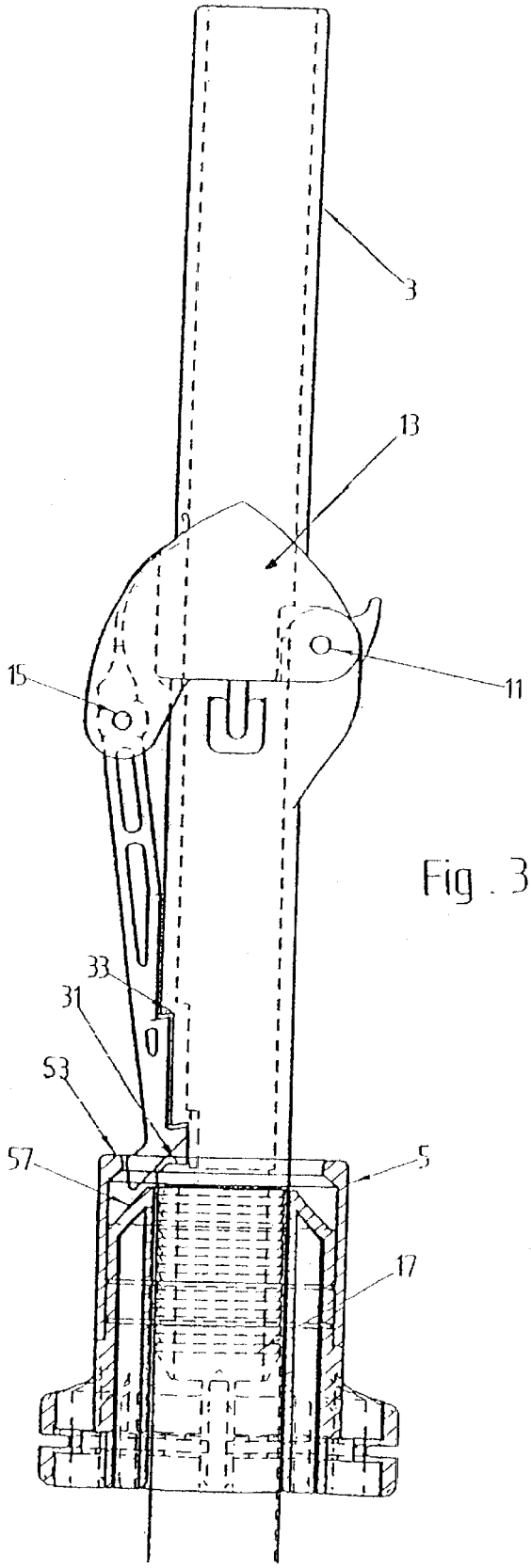
FIG. 3A shows a side view, partly in section, of the assembly with the runner engaged on the lever but before tilting.

In the embodiment shown, the connection of the runner movement to the tilt action is effected by a lever 21 extending from an attachment point near the base of the upper shaft part 3, generally parallel to the shaft, downwards along the lower shaft part to the runner, and by a corresponding construction of the runner 5 itself, to be explained below. The lever 21 is pivoted near its upper end on a pivot axis 15 located parallel to, and at approximately the same height as, the pivot axis 11 in a suitably shaped base portion 13 of the upper shaft part 3; this base portion is constituted by two roughly triangular plates moulded onto opposite sides of the lower end of the upper shaft part. The pivot axes 11 and 15 lie on opposite sides of the central shaft axis. The other end of the lever 21 has a foot-like shape, shown from the side in FIGS. 3A and 3B, with an inner catch or heel 23, an inclined lower surface 24 and an outwardly protruding toe or lug 25, the functions of which various parts will become apparent subsequently. The upper end of the lever 21 also has a spring leaf 29 which in the straight configuration of the shaft provides a restoring means to press against the upper shaft part 3, and hence urges the foot end of the lever against the lower shaft part 1.

The lower shaft part 1 has a recess 31 which is engaged by the heel 23 of the lever and has a shoulder 33 which is matched and engaged by a shoulder 27 on the lever, under the urging of the spring leaf 29, when the shaft is straight. There is also a shoulder 33 which matches a shoulder 27 on the lever. Both shaft parts and the lever can be made for instance of a plastics material or of steel or any suitable alloy, the latter particularly in the case of the shaft. In fact the lower shaft part 1 is itself made in two sections, the upper or hinge section 1*a* and the lower section 1*b*, providing the main length of the shaft. The hinge section 1*a* of the lower shaft part 1 is sufficiently long to accommodate the mechanism, say about 20 cm long, and has an end portion 17 with ridges for insertion into the lower section or pole 1*b*. At its top end, in the vicinity of and to one side of the hinge, the shaft section 1*a* has a boss 41 extending outwards, in which is a groove constituting a guide for the cord used to raise the runner.

Figure 4A:
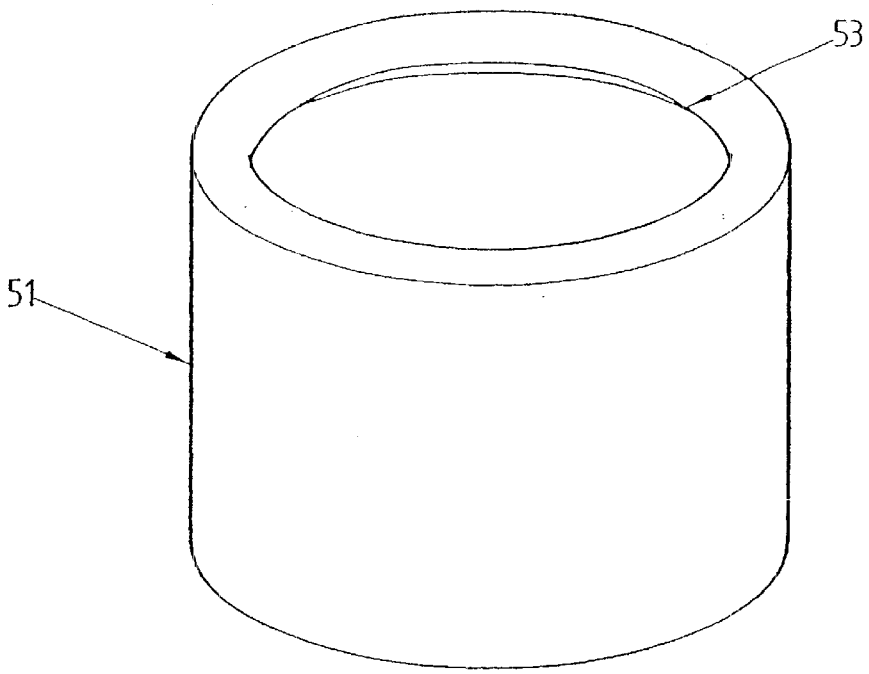
FIGS. 4A and 4B show the main parts of the runner assembly.
Figure 4B:
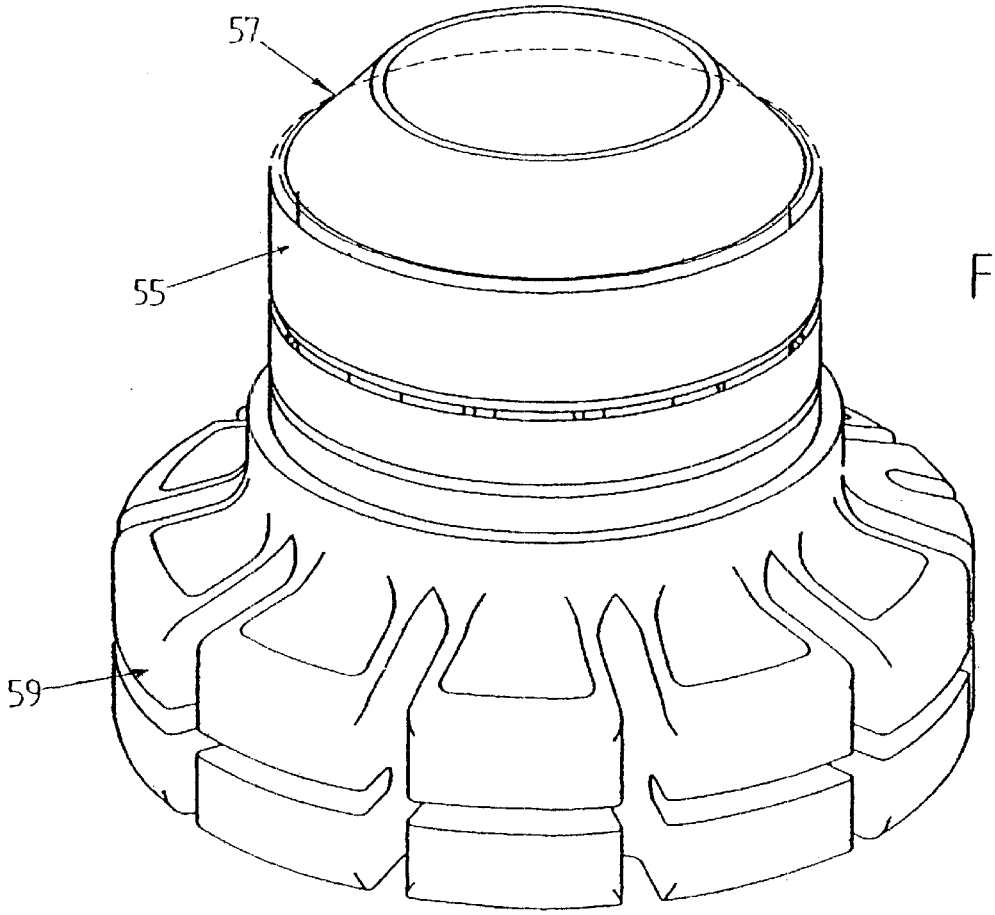

The runner 5 is constructed in two main parts, namely an outer ring or sleeve 51, as shown in FIG. 4A, and a core 55, as shown in FIG. 4B, the ring fitting over and engaging with the core as shown in FIG. 3. A one-piece construction would also be possible though the two-piece version may be easier to manufacture. The two parts are held together by engagement of two internal annular ridges (not shown) in the sleeve 51 with corresponding grooves in the exterior of the cylindrical section of the core 55; alternatively or additionally they can be glued together. The upper rim of the ring 51 has an inwardly facing bead 53 for co-operating with the toe 25 of the lever, and the lower part of the core has a flange 59 into which the inner ends of the stretchers are fastened, and may also have a downwardly extending sleeve part (not shown) to act as a grip for manual operation of the umbrella. The upper end of the core 55 is bevelled so as to form a sloping surface 57 co-operating with the sloping lower surface or sole 24 of the foot of the lever, as will be explained.

In terms of materials, typically the hinge section of the lower shaft part can be made of a plastics material such as acetal or nylon, the pole of aluminium, steel or wood, and the upper shaft section of nylon. The lever can be made of acetal, while one or both parts of the runner can be made of a cheaper plastics material such as HDPE.

Operation of the umbrella from the folded state is as follows. The runner is first raised, by hand or, as depicted in FIG. 5, by a mechanism such as a crank 60 which controls a cord 61 passing up through the shaft (or in the case of a wooden shaft outside the shaft), returning round the guide 41 (or pulley) and down to the runner, until the runner is raised sufficiently far for the ribs and stretchers to be extended and the cover taut. At this point the runner is approximately in the position shown in FIG. 3A. If the umbrella is to stay straight this is the end of the operation.

If the user wants to tilt the umbrella he simply lifts the runner a little further, until the bevelled surface 57 of the core of the runner 5 starts to ride under the sole 24 of the foot of the lever 21. The lever is thus pivoted radially outwards, clearing the recess 31. The clearance between the toe 25 of the lever and the inner rim 53 of the ring 51 is chosen to accommodate this amount of radial travel but little more, so that the foot of the lever is then trapped under the rim 53. The runner then pushes the lever upwards by pressure of the bevelled surface 57 against the sole 24, the heel 23 sliding axially upwards over the lower shaft 1.

As the lever travels upwards it exerts a torque, via its pivot axis 15 on the base portion 13, around the pivot axis 11 on the upper shaft part 3, and the upper shaft part tilts. This tilting continues as long as required, if the cable mechanism is capable of holding the head of the umbrella in position, or the tilting is stopped when the heel 23 reaches the shoulder 33 on the shaft. This is the end position for stopping tilting since the foot end of the lever is not able to swing out any further to clear this shoulder due to the engagement of the runner.

For the reverse operation the handle is cranked the other way and the runner 5 is moved downwards, drawing the lever with it via the bead 53 and the toe 25, until the lower limit of travel of the lever is reached and the heel 23 again engages into the recess 31 under the action of the leaf spring 29. At this point the rim 53 no longer engages with the foot of the lever and the runner can travel further downwards if required.

It is advantageous that the runner can also be used to pull the lever downwards, because this allows a positive "untilting" operation as well as the tilting. However, the straightening of the umbrella shaft could also be effected by way of a suitable return spring, if it were sufficiently strong. The disadvantage of such an arrangement would be that the tilting action would have to take place against the force of this spring.

Another alternative would be a separate manually operated return mechanism such as a second cord. This could be incorporated into the crank mechanism, so as to form a cord system to pull the runner down the shaft as well as up it; the mechanism could also serve the purpose of holding the upper shaft part 3 at any desired angle of tilt.

In place of the crank 60 and cord 61 of FIG. 5 a crank 60 and rack mechanism 62, as depicted in FIG. 6, or a draw cord, as depicted in FIG. 7 can be utilized.

What is claimed is:

1. An umbrella frame, comprising an upper shaft part; a lower shaft part, a tilting joint connecting the upper shaft part and the lower shaft part to enable the upper shaft part to tilt with respect to the lower shaft part; a runner slidably positioned on the lower shaft part, for spreading a cover of an umbrella into an unfurled configuration; and a lever having an upper end pivotally connected to the outside the upper shaft part and a lower end, the lower end being urged to engage the lower shaft part, the lever acting to tilt the upper shaft part under the influence of the runner as the runner is pushed upward beyond a predetermined point at or near a point corresponding to the unfurled configuration; wherein the upper shaft part and the lower shaft part are pivotally connected about a first pivot axis located radially outwards of an axis of the upper shaft part, and the lever is pivotally connected to the upper shaft part by a second pivot axis substantially on the same level with and parallel to the first pivot axis, and on the opposite side of the upper shaft part from the first pivot axis when the upper shaft part is in a fully tilted position.

2. An umbrella frame according to claim 1, in which the lever includes means for holding the lever captive on the runner.

3. An umbrella frame according to claim 2, in which the means for holding the lever comprises an outwardly facing lug near a lower end of the lever, and an inwardly facing lip of the runner adapted to engage the lug during a tilting operation.

4. An umbrella frame according to claim 3, in which the lower shaft part has a recess allowing the lower end of the lever to be pressed further inwards into the recess as the runner travels downwardly to release the lever from the runner and thus to lock the upper shaft part in the straight position.

5. An umbrella frame according to claim 4, further comprising restoring means urging the lower end of the lever against the lower shaft part so as to ensure that the lip of the runner travels over the lug of the lever as the runner travels upwards up to and past a point of first engagement of the runner and the lever.

6. An umbrella frame according to claim 5, in which the runner and the lug have suitable inclined surfaces such that upward movement of the runner lifts the lower end of the lever out of the recess, freeing the lever to be pushed upwards.

7. An umbrella frame according to claim 6, in which the runner includes a sleeve-shaped upper section of a diameter greater than the diameter of the shaft, the upper edge of the sleeve-shaped section including the lip of the runner.

8. An umbrella frame according to claim 4, further comprising tilt stop means for arresting the lever and thus preventing the upper shaft part from tilting beyond a pre-established point.

9. An umbrella frame according to claim 4, which the recess is at a point at which the runner first engages the lug.

10. A tilting umbrella, comprising an umbrella frame according to claim 1; an umbrella cover, means for lifting the runner to unfurl the umbrella cover and subsequently tilt the upper shaft part, so as to tilt the umbrella, said means being located on the lower shaft part so as to be accessible to a user of the umbrella.

11. A tilting umbrella as claimed in claim 10, wherein said means comprises a crank; and a cord for lifting the runner in response to turning of the crank.

12. A tilting umbrella as claimed in claim 11, wherein said means comprises a crank; and a rack mechanism for lifting the runner in response to turning of the crank.

13. A tilting umbrella as claimed in claim 11, wherein said means comprises as draw cord.

* * * * *